United States Patent [19]

Cummings

[11] Patent Number: 4,811,645

[45] Date of Patent: Mar. 14, 1989

[54] TUNING MECHANISM FOR STRINGED INSTRUMENT

[76] Inventor: Larry E. Cummings, 88056 Grand View Dr., Springfield, Oreg. 97478

[21] Appl. No.: 152,201

[22] Filed: Feb. 4, 1988

[51] Int. Cl.[4] ..... G10D 3/14

[52] U.S. Cl. ..... 84/207; 84/304

[58] Field of Search ..... 84/207, 304–306, 84/313

[56] References Cited

U.S. PATENT DOCUMENTS

| | | | |
|---|---|---|---|
| 613,900 | 11/1898 | George | 84/207 |
| 806,949 | 12/1905 | Braun | 84/207 |
| 1,135,314 | 4/1915 | Oberhoffer | 84/305 |
| 4,004,485 | 1/1977 | Hiscott | 84/207 |
| 4,512,232 | 4/1985 | Schaller | 84/313 |
| 4,674,387 | 6/1987 | Caruth | 84/304 |

*Primary Examiner*—Lawrence R. Franklin

*Attorney, Agent, or Firm*—Henderson & Sturm

[57] ABSTRACT

The tuning mechanism comprises a support which carries a shaft on which is mounted an arm that extends generally as a radius of the shaft. The arm has a turnable assembly that receives and retains a string of the instrument, and the assembly may be turned to tension the string. Further, the arm is rockable relative to the support for further adjusting the string so as to afford fine tuning. The turnable assembly is received in a bore in the arm and is made up of a stud over which is sleeved a coil spring via a frictional fit and the spring is connected at one end to the arm whereby the stud, to which the string is attached, is limited to one-way turning in the direction of string tightening.

3 Claims, 1 Drawing Sheet

Fig. 1
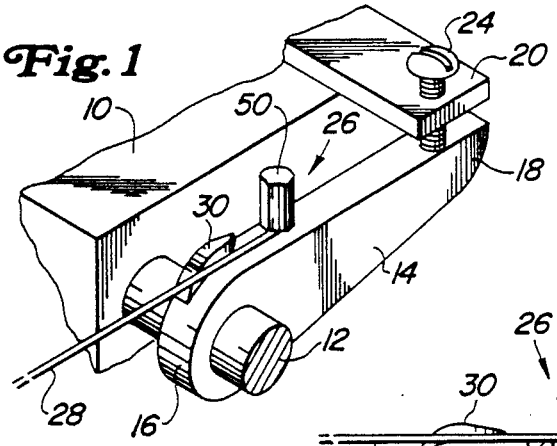
Fig. 2
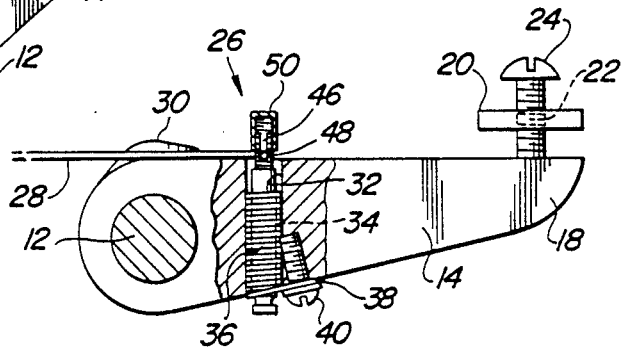
Fig. 3
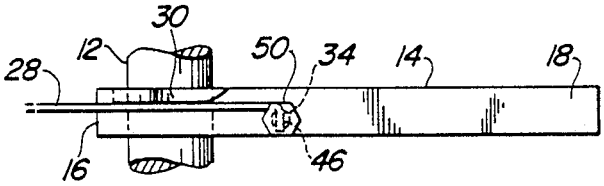
Fig. 4
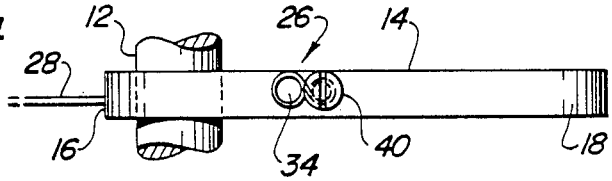
Fig. 5
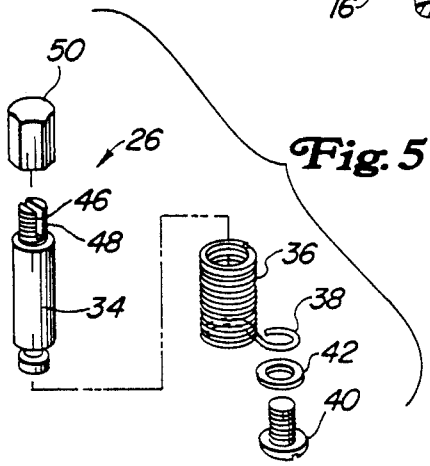
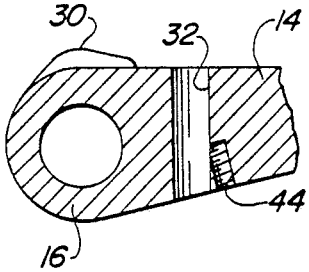
Fig. 6

TUNING MECHANISM FOR STRINGED INSTRUMENT

BACKGROUND AND SUMMARY OF THE INVENTION

Many forms of tuning mechanism exist in the prior art, including pegs, ratchets and the like and some even have provision for fine tuning of the instrument strings. According to the present invention, a novel and simple arrangement is afforded whereby the several strings of a musical instrument may be accurately tuned individually and in such manner as to prevent inadvertent retrograde turning of parts that would tend to relax the tension on the strings. The arrangement is compact, low-cost and easily operated. Further advantages and features of the invention will become apparent as a preferred embodiment of the invention is disclosed in detail in the ensuing description and accompanying drawings.

DESCRIPTION OF THE DRAWINGS

FIG. 1 is a simplified perspective, with parts broken away, of a representative form of structure in which the invention finds utility.

FIG. 2 is an elevation, with a portion shown in section, of the rockable arm structure.

FIG. 3 is a plan view of the same.

FIG. 4 is a bottom view of the same

FIG. 5 is an "exploded" perspective of the turnable assembly.

FIG. 6 is a fragmentary section of the shaft-proximate end of the arm.

DETAILED DESCRIPTION OF THE PREFERRED EMBODIMENT OF THE INVENTION

In FIG. 1, the numeral (10) designates a support that may be taken as representative of many structures with which the invention may be used. The support is shown as carrying a shaft (12), here arranged horizontally, and this shaft in turn carries an arm (14), of which there may be several; e.g., six to ten. The arm has a rear end or heel (16) mounted on the shaft so as to be rockable about the shaft axis and the arm extends forwardly substantially as a radius of the shaft to a front end or toe (18). The support (10) has affixed thereto in any suitable manner a projection (20) that is disposed in overhanging relation to the top of the front end of the arm and this projection has a vertical threaded bore (22) in which is threaded an adjusting screw (24) whose lower end engages the top of the front part of the arm whereby adjusting of the screw will effect angular movement or rocking of the arm in relatively small increments, the screw threads being preferably rather fine.

A turnable assembly (26) is carried by the arm intermediate its front and rear ends and is connected to an instrument string (28) that extends rearwardly over and in engagement with the top of the rear part or heel of the arm. The arm in this area may include a raised guide (30) to assist in retaining alignment of the string. From the description thus far, it will be seen that rocking of the arm via the adjusting means (22) will vary the tension in the string (28).

For the purpose of carrying the assembly (26), the arm has a vertical bore (32). The assembly (26) is made up of a vertical stud (34) over which is sleeved a coil spring (36) via a frictional fit. The o.d. of the spring fairly closely fits the i.d. of the bore (32). The spring is formed at its lower end with a loop (38) that is affixed to the bottom of the arm by attachment means in the form of a small screw (40) which passes through a lock washer (42) and is threaded into a tapped bore (44) in the bottom of the arm. The wrap of the spring about the stud is such that the stud can be turned in one direction only; that is to say, in a normal right-hand direction, during which phase the stud can turn because it does not tighten the wrap of the spring on itself. When turned in the opposite direction, the stud increases the spring wrap and, since the spring is held by the bottom screw (40), it cannot turn and neither can the stud.

The foregoing is significant because the string (28) is attached to the assembly (26) by means of a slot (46) in an upper screw-threaded end (48) of the stud (34), the string being received in the slot and wrapped a few turns about the portion (48), following which a cap (50) is threaded onto the end (48) to retain the string. The cap is right-hand-threaded and may also be used to turn the stud (34) in a right-hand direction so as to tension the string (28). Since the stud cannot turn in a left-hand direction, retrograde turning of the stud is prevented and consequently slackening of the string cannot occur. As an alternate means of turning the stud (34), a screw driver may be used in the slot (46) when the cap is removed. Other means of turning the stud may be employed, many of which will readily suggest themselves on the basis of the present disclosure.

In the use of the invention, initial tensioning of the string may be obtained by turning the stud (34) as described above. Further fine tuning is available by means of the screw (24) acting on the front of the arm. It will be understood that as many arms and assemblies (26) will be used in an instrument according to the number of strings involved. It is clear of course that the adjustments may be made individually. It should be further recognized that the foregoing disclosure is based on a preferred embodiment of the invention and that many modifications may be made therein without departure from the spirit and scope of the invention.

I claim:

1. For use with a stringed instrument having a support, fine-tuning mechanism comprising a horizontal shaft carried by the support, arm having a rear end carried by the shaft and projecting forwardly and substantially horizontally as a radius of the shaft to a front terminal end, said arm having vertical through bore intermediate its ends, a stud received in the bore for turning about the bore axis and having upper and lower ends projecting respectively above and below the upper and lower portions of the arms, said upper end being formed with a slot therein for receiving a string trained over and extending rearwardly from the arm, a coil spring sleeved over and having a frictional fit with the stud and dimensioned to fit within the bore, said spring having a lower end projecting at the lower end of the stud, and means securing the lower end of the spring to the arm whereby the stud is capable of one-way turning in the bore for tensioning the spring.

2. The tuning mechanism of claim 1, in which the upper end of the stud is externally screw threaded, and an internally-threaded cap is received by said upper end for locking the string in the slot.

3. The tuning mechanism of claim 1, in which the lower part of the arm has a generally upright tapped bore therein, and the means securing the lower end of the spring is a screw threaded into the tapped bore.

* * * * *